US005313672A

United States Patent [19]

Luedtke et al.

[11] Patent Number: 5,313,672

[45] Date of Patent: May 24, 1994

[54] URINAL MAT

[76] Inventors: Richard C. Luedtke, Whiteladyes, Sandy Way, Cobham, Surrey KT11; Kandiah Mahanandan, Woden Cottage, Firs Road, Kenley, Surrey CR2, both of United Kingdom

[21] Appl. No.: 699,214

[22] Filed: May 13, 1991

[51] Int. Cl.[5] ..... E03D 13/00

[52] U.S. Cl. ..... 4/301; 4/309; 4/DIG. 5; 4/144.1

[58] Field of Search ..... 4/DIG. 5, 661, 301, 4/300.3, 309, 144.1, 144.2, 144.3, 144.4, 581, 114.1, 462, 463, 222.1

[56] References Cited

U.S. PATENT DOCUMENTS

D. 258,472 3/1981 Adam ..... 4/661 X
3,614,790 5/1969 Billingsly et al. ..... 4/300.3
4,574,403 3/1986 Dintemann et al. ..... 4/309
4,671,976 6/1987 Vidal ..... 4/292
4,866,793 8/1989 Luedtke et al. ..... 4/300.3

*Primary Examiner*—Henry J. Recla
*Assistant Examiner*—David J. Walczak
*Attorney, Agent, or Firm*—Allan L. Harms

[57] ABSTRACT

A urinal mat provided with upstanding baffles to decelerate a stream of urine impinging thereon. The base of the mat is contoured and flexible to conform generally to the geometry within the urinal. Openings through the base are provided to permit liquids to drain through. Optionally provided are upstanding posts to receive a cake of deodorant thereon. An alternative embodiment provides a depression in the base into which deodorant may be deposited during manufacture. A flexible flange depends from an edge of the mat to engage the urinal sidewall in order to direct flush water over the mat.

8 Claims, 4 Drawing Sheets

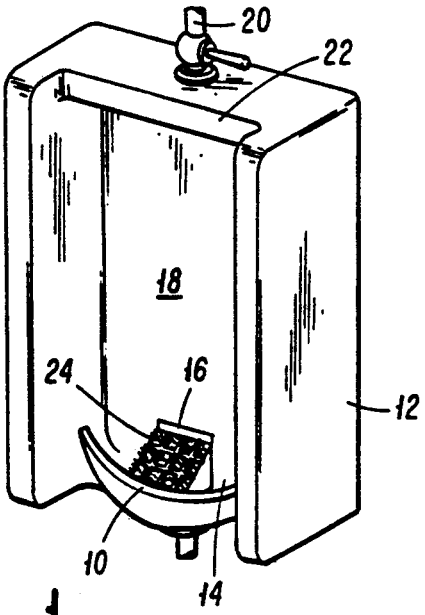
FIG. 1
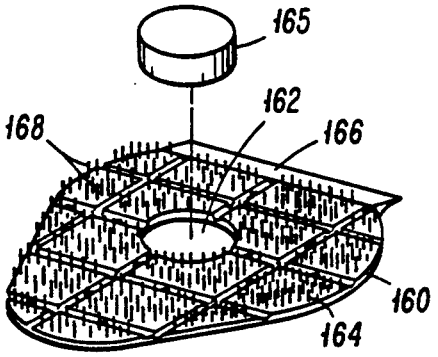
FIG. 10
FIG. 11
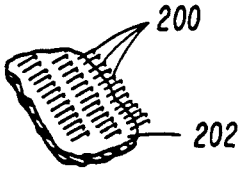
FIG. 12
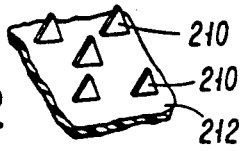
FIG. 13
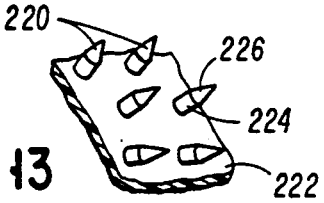
FIG. 14
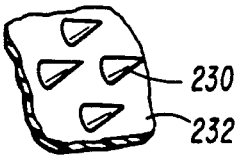
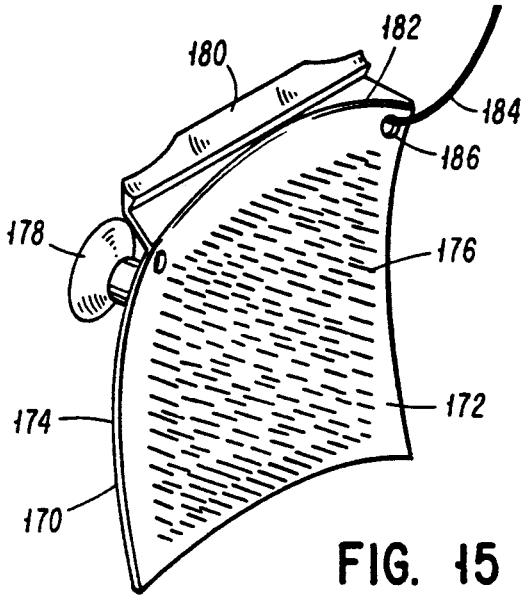
FIG. 15
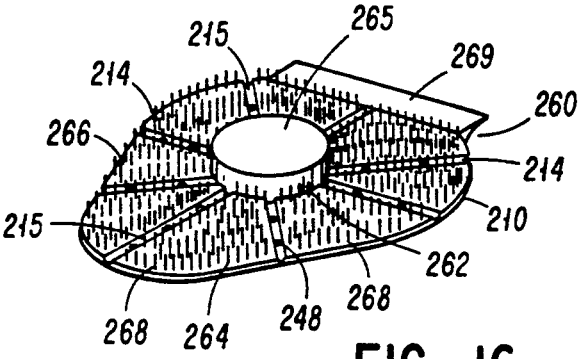
FIG. 16

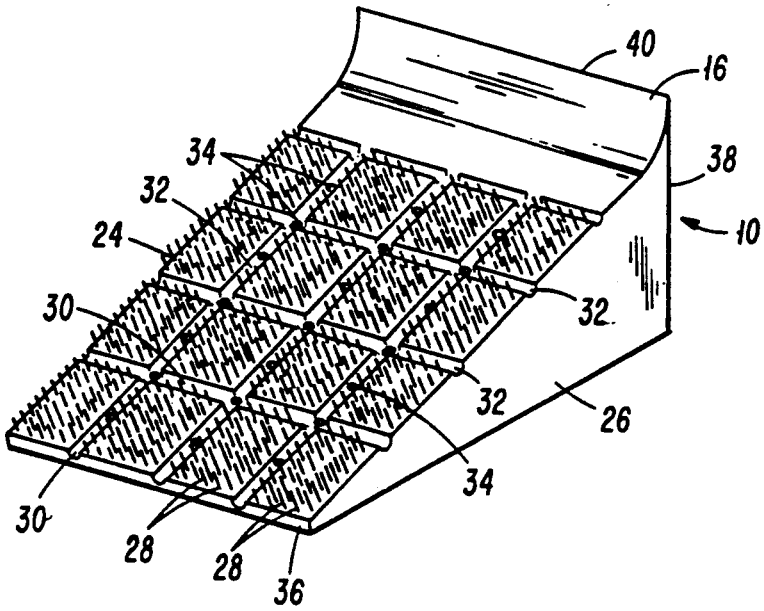
FIG. 17
FIG. 9
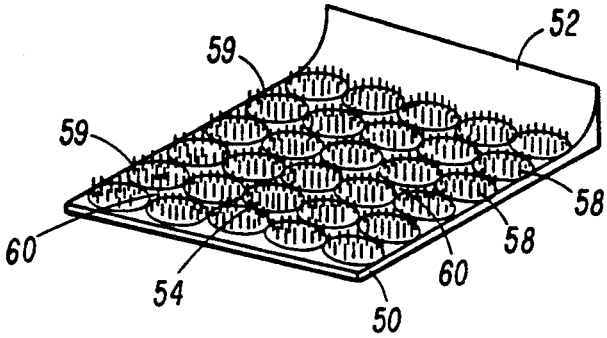
FIG. 3
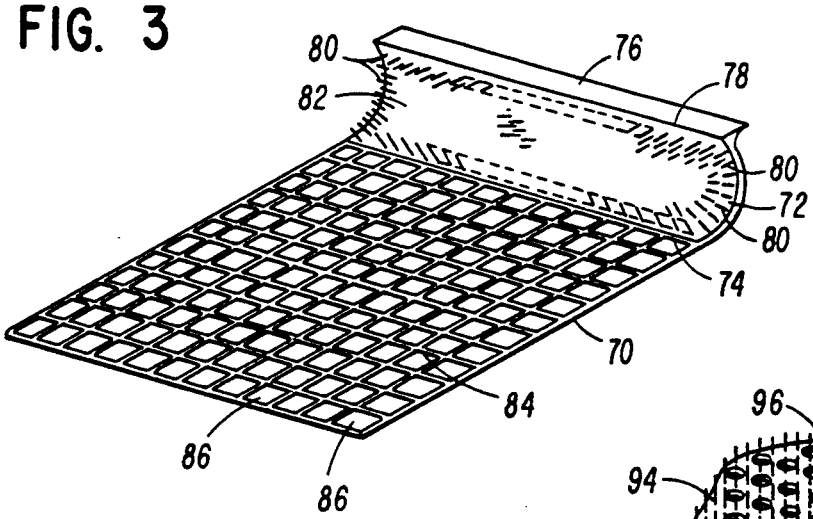
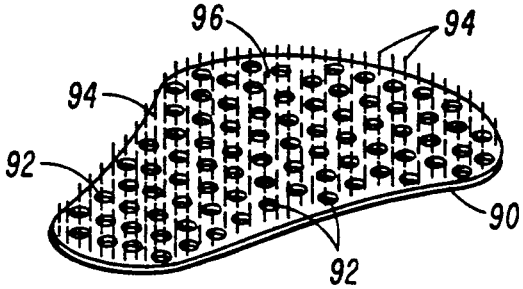
FIG. 4

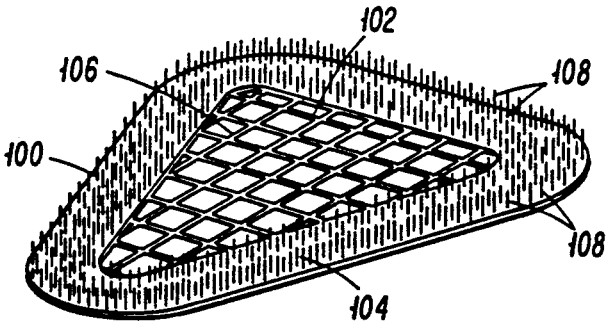
FIG. 5
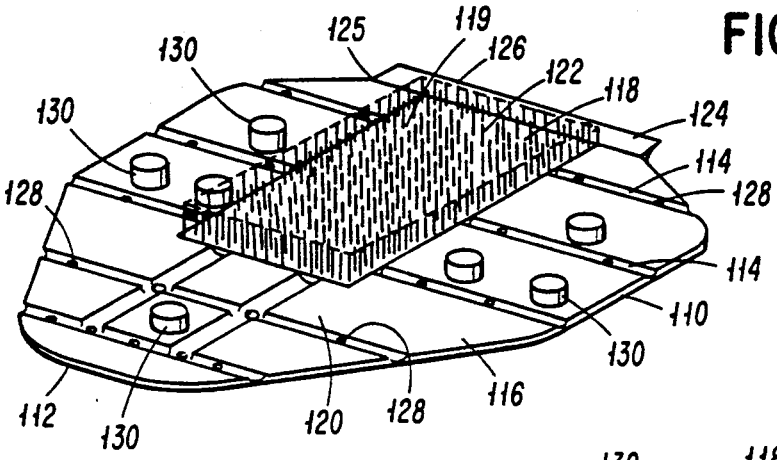
FIG. 6
FIG. 7
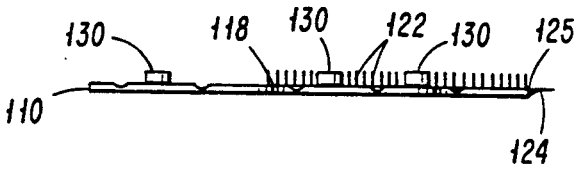
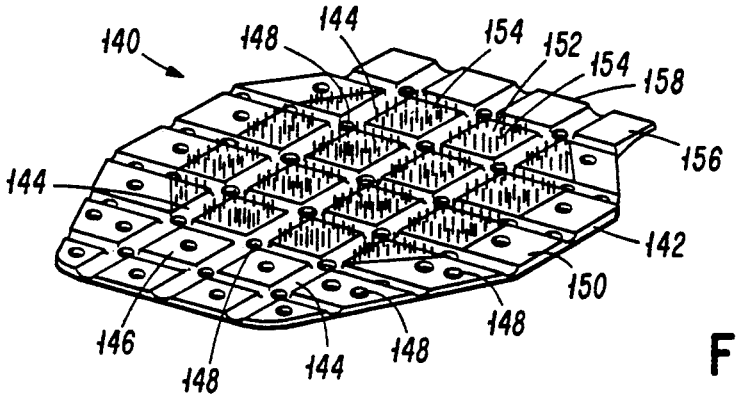
FIG. 8

URINAL MAT

BACKGROUND OF THE INVENTION

This invention pertains to accessories for urinals and more particularly to anti-splash drain mats for urinals.

The typical men's restroom-provided urinal comprises a vertically disposed, porcelain-surfaced receptacle having a collection region at the bottom with a drain disposed therein. Vertical, smooth-sided walls extend above the collection region to provide a surface to receive urination streams and over which water used to flush the urinal is directed on demand or pursuant to periodic control means. Urinal devices typically are wall mounted or floor mounted, though wall mounted versions of the devices are currently more commonplace.

In the customary men's urinal, a small amount of water remains in the collection area between flushes to dilute the urine being collected. This water remains at an ambient level much as water stands between flushes in the commonly used toilet bowl. Some portion of the ambient water pool is accessible in the bottom of the urinal. The drain opening of the urinal may be covered by a screen or a grid or it may comprise openings in the sidewalls of the urinal or in a projecting hub disposed near the bottom of the collection region.

The presence of hard and reflective surfaces commonly encountered in the collection area of a urinal creates a source of splash of liquid droplets as a male individual begins to direct a stream of urine into the urinal and particularly into the collection region where an ambient liquid level may be present. The impingement of the urine stream upon the surface of the ambient pool in the bottom of the urinal induces the scattering of liquid droplets to the outside of the urinal and possibly onto the clothing of the urinal user.

Few efforts have been directed to the reduction of splash from a urinal fixture. Though drain mats are well know, their purpose has been to collect solid debris which otherwise, when deposited in a urinal, would pass into the drain openings and clog or obstruct the drain system for the urinal. The typical urinal mat is a flexible sheet of synthesized material having a screen or grid region through which the urine and other liquids are to pass while solid debris is intended to be collected on the screen or grid surface. The urinal mat is shaped to generally conform to the geometry of the collection area of the urinal and to overlie the drain openings of the urinal. Unfortunately, the presence of a drain mat increases the likelihood of splash of urine droplets as the urine stream strikes the grid or screen surface or other regions of the mat.

Because of the poorly controlled disposal of urine droplets in the usual system, unpleasant odors frequently accompany the presence of urinals, arising from the deposit of odor-causing urine on surrounding floor or wall surfaces. Deodorant materials formed into cakes are commonly used to mask or absorb the undesirable odors accompanying the urinal. Such cakes are available in rings or square or cylindrical blocks.

A successful device for reduction of urine splash when a urine stream is directed into a toilet bowl is presented in our earlier patent entitled "Toilet Anti-splash Device", U.S. Pat. No. 4,866,793. However, the devices disclosed in this patent are not directed to the reduction of splash-back from a urinal. The present invention provides novel means for solution of this type of problem.

SUMMARY OF THE INVENTION

Accordingly, an improved urinal mat is disclosed which absorbs the impinging urine stream of a male using the urinal, thereby preventing the back splash of urine droplets onto the clothing of the user or onto surrounding surfaces.

A generally planar base is disposable within the collection area of a urinal in a position to overlie the drain openings of the urinal. The base is sized or contoured to fit within the generally curved sidewalls of the collection area of the urinal. The base is provided with a large plurality of spaced apart baffles on most or part of its upper surface. The baffles depend generally perpendicularly from the upper surface of the base and form a textured, permeable surface for the urinal mat.

The urinal mat is provided with openings through the mat which permit liquids to pass through the mat while not allowing passage of debris or solid matter. Such debris or solid matter is retained on the face of the urinal mat until removed during periodic cleaning of the urinal.

The baffles comprise tiny flexible protrusions which may be shaped cylindrically, conically, pyramidically or in other shapes such as tiny hooks or complex constructions such as cones supported upon cylinders. In all cases, the baffles are quite small relative to the overall urinal mat.

In the preferred embodiment, all parts of the mat are constructed of formed, somewhat flexible plastic material of cell configuration which may be impregnated with encapsulated fragrance which is released gradually.

In an alternative embodiment, voids are provided among the baffles which may comprise drain channels which are communicative with the openings provided through the base of the mat. In one embodiment, the voids comprise a gridwork of channels for liquids to pass along leading to the openings through the mat.

A flange element is provided upon a first edge of the mat, said flange element being disposed to engage the sidewall of the urinal such that when flushing of the urinal occurs, a portion of the water cascading down the urinal sidewall will be collected by the flange and directed over the top surface of the urinal mat.

In an alternate embodiment, the novel baffles are applied to a mat having a grid or screen region wherein the grid or screen functions as in the prior art devices while the region of the mat carrying the baffles perform the novel splash abatement function.

In yet another embodiment of the invention, standoff means are provided on the upper surface to receive a cake or block of deodorant or disinfectant material which is designed to dissolve slowly as water or urine engages its surface, thereby disseminating dissolved deodorant or disinfectant (as the case may be) over the mat generally.

In a further embodiment, a depression is formed on the base, into which is deposited a quantity of deodorant or disinfectant material during the manufacturing process. The deodorant or disinfectant material becomes solidified, to be available to gradually dissolve as liquids encounter the solid deodorant or disinfectant material as the mat is used in the urinal.

One object of the invention is to provide a urinal mat having features to abate the splash back of urine as it is deposited in the urinal.

Another object of the invention is to provide a urinal mat with anti-splash characteristics which includes means for receiving a cake of deodorant or disinfectant material.

Another object is to provide a novel urinal splash reducing mat which may be mounted to the sidewall of the urinal.

Another object of the invention is to provide a urinal mat in which encapsulated fragrance or dye may be impregnated during manufacturing.

Another object of the invention is to provide a urinal mat which will emit a fragrance.

These and other objects of the invention will become apparent from the detailed description of the invention which follows.

DESCRIPTION OF THE DRAWING FIGURES

FIG. 1 is a perspective view of urinal having the invention in place therein.

FIG. 3 is a view in perspective of an alternative embodiment of the invention.

FIG. 4 is a view in perspective of another alternative embodiment of the invention.

FIG. 5 is a view in perspective of another alternative embodiment of the invention.

FIG. 6 is a view in perspective of yet another alternative embodiment of the invention.

FIG. 7 is a plan view of the embodiment of FIG. 6.

FIG. 8 is a view in perspective of another alternative embodiment of the invention.

FIG. 9 is a view in perspective of an another alternative embodiment of the invention.

FIG. 10 is a view in perspective of another alternative embodiment of the invention with a cake of deodorant material shown in exploded position therefrom.

FIG. 11 is an enlarged view of a segment of the upper surface of an alternative embodiment of the invention.

FIG. 12 is an enlarged view of a segment of the upper surface of an alternative embodiment of the invention.

FIG. 13 is an enlarged view of a segment of the upper surface of another alternative embodiment of the invention.

FIG. 14 is an enlarged view of a segment of the upper surface of another alternative embodiment of the invention.

FIG. 15 is a perspective view of another embodiment of the invention.

FIG. 16 is a perspective view of another embodiment of the invention showing a cake of deodorant material in place thereon.

FIG. 17 is an perspective view of another embodiment of the invention.

DETAILED DESCRIPTION OF THE INVENTION

Figure 2:
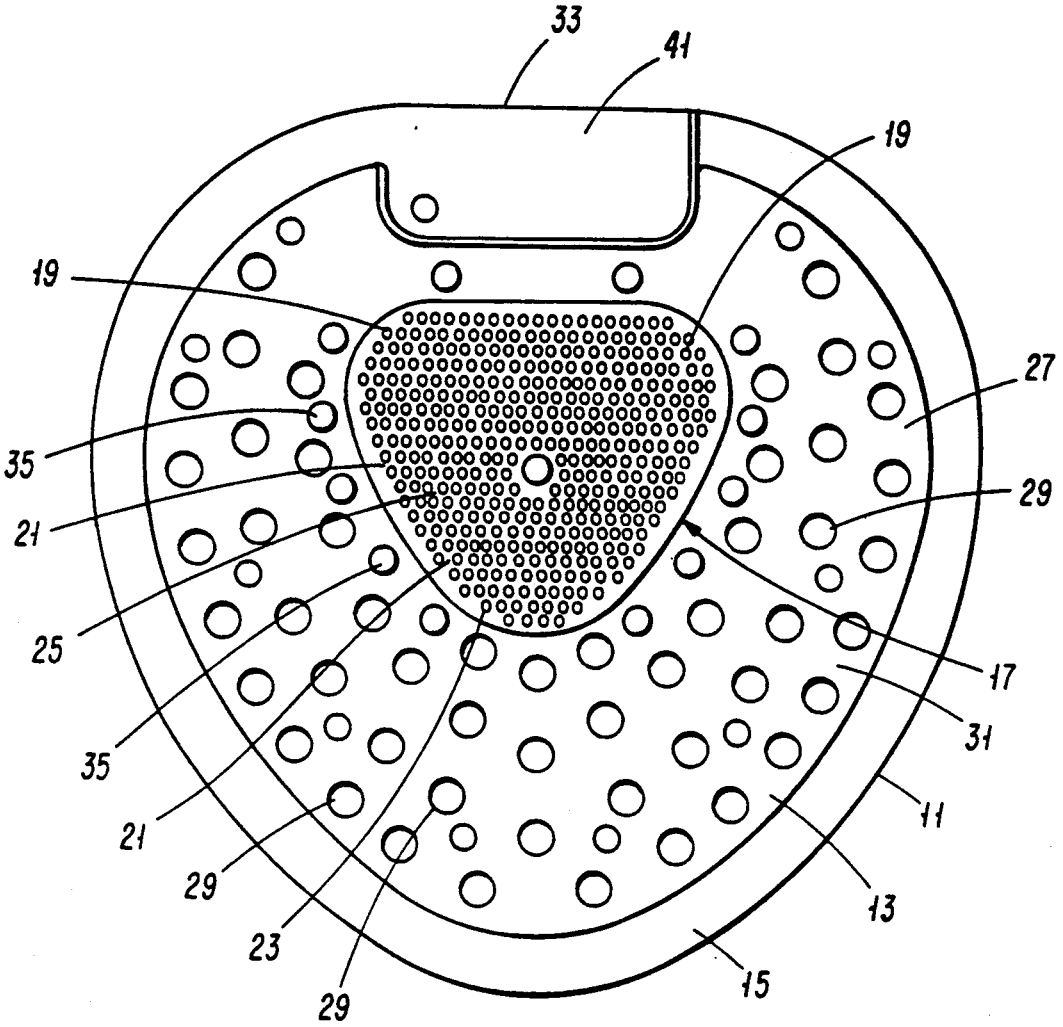
FIG. 2 is a top plan view of the preferred embodiment of the invention.

Referring to the drawings and in particular to FIG. 1, the urinal mat invention is illustrated by the numeral 10 and is shown disposed in a urinal 12, resting within collection region 14 thereof. Urinal mat invention 10 is shaped to fit the contours of collection region 14 and to overlie the drain elements (not in view) of urinal 12. Invention 10 is provided with flange 16 which lies in engagement with sidewall 18 of urinal 12. When urinal 12 is flushed, water enters urinal 12 by feedpipe 20 and is delivered under rim 22 to cascade down sidewall 18 and be directed by flange 16 over the upper surface 24 of invention 10.

An embodiment of invention 10 is visualized in FIG. 17 in more detail where the base 26 of invention 10 comprises a sloped wedge having upper surface 24 disposed thereupon. A multiplicity of baffles 28 populate the upper surface 24 of invention 10. In the preferred embodiment, baffles 28 comprise coparallel elongate posts depending generally perpendicularly from the plane of upper surface 24 and upstanding thereupon. Baffles 28 and the interstices therebetween create a textured surface, which, when struck by a stream of fluid such as urine, decelerates the speed of the urine stream. Upper surface 24 is featured with voids 30 which comprise a network of channels 32 over which liquids including urine which has impinged baffles 28 may pass until drained through upper surface 24 through apertures 34 which communicate with channels 32.

Base 26 is tapered from front edge 36 to rear terminus 38 to provide a slope to upper surface 24. Depending upwardly along rear terminus 38 is flange element 16 which terminates with edge 40. Flange element 16 is constructed of generally resilient material thereby allowing edge 40 to conform to the contours of sidewall 18 of urinal 12, when edge 40 is placed in contact therewith. In practice it is found that the vertical dimension of terminus 38 should be maintained in the range of 1 to 1.5 inches and preferably approximately 1.25 inches, while the vertical dimension of front edge 36 is preferably approximately 0.125 inches.

The preferred embodiment of the invention is disclosed in FIG. 2 in top plan view. The urinal mat 11 comprises a curvilinear base 13 circumscribed by a flange 15. Base 13 is provided with a central region 17 therewithin upon which are formed a multiplicity of impingement baffles 19, each baffle 19 being spaced apart from the others. Baffles 19 comprise erect, thin members all depending generally perpendicularly from base 13. The interstices 21 among baffles 19 are relatively small allowing the distal ends 23 of baffles 19 to form a textured surface 25. Base 13 is equipped with openings 29 on the second region 27 thereof which generally surrounds central region 17 of base 13. Openings 29 are sufficiently numerous to allow many routes for liquids reaching top surface 31 of base 13 to pass through base 13. Linear region 41 is provided along a length of flange 15 to provide a wiper 33 which may collect flushing water passing over a sidewall of the urinal when wiper 33 is engaged with the sidewall.

Posts 35 upstand from second region 27 of base 13 to provide a protective barrier to lateral forces of cleaning tools, or the like, which might damage baffles 19.

It is intended that mat 11 be formed by injection molding techniques from suitable plastic compounds which cure into a flexible material. An optional feature of the invention is to construct mat 11 of a plastic which has a cell configuration that allows it to be impregnated with fragrance, thereby resulting in mat 11 emanating a fragrant odor. Several different fragrances will be used depending on the user, for it has been determined that urine smell is a negative mood stimulant. To overcome the urine smell the impingement baffles 19 provide many times more surface area than a flat surface, and it is primarily from this area that the encapsulated fragrance is released, thereby mixing with and overcoming the smell of urine, during urination as well as when the urinal is flushed. It has also been determined that younger people are far more sensitive to odors than older ones. To this end the plastic's cell configuration will be capable of accepting varying concentrations of fragrance. However, it must be noted that the invention can be manufactured unscented, but of the same plastic.

Furthermore the plastic's cell configuration will be capable of accepting a dye, retaining the dye and remaining colorfast throughout its useful life. However, it must be noted that the invention can be manufactured in the neutral, undyed, plastic tone.

Another embodiment of the present invention is illustrated in FIG. 3. Though containing elements of the prior art screen-type urinal mats, the embodiment of FIG. 3 employs the novel features of the invention. In FIG. 3 it is seen that a screen 70 is adjoined to concave member 72 which depends from first end 74 of screen 70. A flexible flange 76 depends from free edge 78 of concave member 72. Depending from concave member 72 are a population of baffles 80 forming a textured surface 82 on concave member 72. The baffles 80 of concave member 72 comprise relatively small, relatively thin bristles depending from concave member 72 at their points of attachment to concave member 72. Screen 70 comprises a gridwork 84 having openings 86 interstitially therein.

Another alternative embodiment of the invention is disclosed in the illustration of FIG. 4 wherein a contoured flexible sheet 90 is shaped to generally fit the contours of the collection area in the lower region of a urinal such as urinal 12 seen in FIG. 1. Sheet 90 is provided with a multiplicity of apertures 92 therethrough. Baffles 94 upstandingly depend from top surface 96 of sheet 90.

In the alternative embodiment of the invention shown in FIG. 5, a base 100 comprises a screen 102 which is circumferentially joined to a flange 104. Screen 102 comprises an open grid 106. Baffles 108 generally perpendicularly upstand from flange 104. Base 100 is flexible, permitting it to deflect to rest in the contours of the collection region of a urinal.

An embodiment of the invention having facility for incorporation of deodorant or disinfectant elements therewith is disclosed in FIGS. 6 and 7. Base 110 comprises a somewhat flexible sheet 112 having a network of open ducts 114 formed in upper surface 116 thereof. It is found that a preferred thickness for sheet 112 is nominally 5/32 inches and the preferred dimensions of ducts 114 are ⅛ inch by 5/64 inch nominally. Upper surface 116 is provided with first region 118 surrounded on three of its sides by second region 120. Open ducts 114 are provided on second region 120 only, while a multiplicity of baffles 122 are present upon first region 118 of base 110. Baffles 122 are thin rods spaced apart small distances from each other and upstanding from upper surface 119 of first region 118. A tapered flange 1 24 is attached by flexible "living" hinge 1 25 to base 110 such that free edge 126 thereof will engage a sidewall of the urinal into which the invention is placed, thereby directing flush water onto upper surface 119 of first region 118, as well as onto second region 116 of base 110. Holes 128 are provided through base 110 along ducts 114. Posts 130 are formed on base 110 and are disposed to receive a ring-shaped cake of slowly dissolving disinfectant thereon. Holes 128 vary in size, it being found that some are preferably of the approximate diameter of 0.25 inch, with others of the approximate diameter of 0.125 inch. The larger holes are preferably located at the intersection of ducts 114. It is also found that posts 130 are preferably in the range of 0.375 inch in diameter and 0.5 inches tall.

FIG. 8 illustrates yet another embodiment of the new urinal mat invention. Mat 140 comprises a thin plate 142 formed from flexible material approximately 5/32 inches thick. A grid of channels 144 is formed upon plate 142 at the top surface 146 thereof. Openings 148 pass through plate 142 within channels 144 and also in peripheral region 150 which surrounds central region 152 on which are disposed a covering of baffles 154. Peripheral region 150 includes flange 156 which is provided with linear free edge 158 which is abuttable with the inside wall of a urinal in which mat 140 is placed.

Referring to FIG. 9, an another alternative embodiment of invention 10 is shown. In this embodiment, base 50 is generally a planar, somewhat flexible sheet provided with a curved flange 52 at an end thereof. Formed on upper surface 54 of base 50 are a large plurality of baffles 58, each baffle 58 comprising a thin elongate cylinder perpendicularly fixed at its base to upper surface 54. Groupings 59 of baffles 58 leave voids 60 therebetween. Though groupings 59 of baffles 58 are shown in FIG. 9 as circular, it is to be understood that other shapes of groupings, including randomly occurring shapes, are contemplated and the illustration of FIG. 9 is not intended to limit the disclosure. Voids 60 overlie openings (not seen in FIG. 9) in base 60 which permit liquids to drain through the mat. Voids 50 are sized to restrain the passage of debris, including cigarette remnants, thereinto.

In the embodiment of FIG. 10, mat 160 is provided with centrally disposed well 162 in upper surface 164. Receivable within well 162 is deodorant or disinfectant block 165 which may be deposited in well 162 during manufacture. Flange 166 depends from mat 160 to divert flush water onto surface 164 and onto any deodorant or disinfectant present in well 162, thereby causing the dispersal of dissolved deodorant or disinfectant over the surface 164 of mat 160. Baffles 168 populate surface 164.

Baffles 168 comprise thin upstanding elements spaced small distances from each other.

In FIG. 15, another embodiment of the invention is shown. Base 170 comprises a concavely contoured base having a front face 172 and a rear face 174. Parabolic concavity is preferred for front face 172. Front face 172 is provided with a large plurality of generally parallel, spaced apart impingement baffles 176, each of which depends from front face 172. Suction cup 178 depends from rear face 174 and is disposed to engage and selectively mount to the rear vertical wall of a urinal. Flange element 180 depends from upper edge 182 of base 170 to engage the rear vertical wall of the urinal when suction cup 178 secures base 170 to the wall. Cable 184 is provided to fasten to base 170 at connection 186 and may be secured by suitable means to the urinal.

FIG. 11 depicts an enlarged view of one alternative form of the battles which may be employed on the invention. Surface 202 is populated by baffles 200 which depend from surface 202. Baffles 200 provide a non-reflective texture for surface 202. Baffles 200 approximate tiny hooks depending from face 202 in a substantially non-parallel relationship to face 202.

FIG. 12 discloses an alternative form of baffles for an alternative embodiment of the invention. Substantially triangular plates 210 depend from surface 212 of this alternative embodiment of the invention.

FIG. 13 discloses another form of baffles for an alternative embodiment of the invention. Spike elements 220 depend from surface 222 of this alternative embodiment of the invention. Each spike element 220 comprises a cylinder 224 supporting a cone 226.

FIG. 14 discloses yet another form of baffles of an alternative embodiment of the invention. Cone elements 230 depend from surface 232 of this embodiment.

Yet another embodiment of the invention is depicted in FIG. 16 where a deodorant cake 265 is disposed in well 262 recessed in top surface 264 of mat 260. In this embodiment, channels 244 radially extend from well 262. Channels 244 are communicative with drain openings 248 which penetrate through base 210. Baffle members 268 populate top surface 264 of mat 260 except in channels 214 creating voids 215 spaced within textured surface 266 provided by upstanding baffle members 268. Flange 266 depends from base 210 to engage a urinal vertical wall to direct flushing water from the wall over surface 264 and into contact with cake 265. As a urine stream impinges on textured surface 266, its velocity is reduced by the impingement upon baffle members 268. The urine may then pass into channels 244 and pass through drain openings 248 and into the drain of the urinal in which the mat is placed.

It should be recognized that variations in the materials used or shapes employed may be made and that such modifications do not depart from the scope of the invention.

Having described the invention, we claim:

1. A mat for placement in a urinal having a back wall and a floor having a drain therein, said mat overlying the drain of the urinal to restrain the passage of debris into the drain of the urinal while allowing liquids to pass therethrough, comprising a base having a generally planar upper surface and a lower surface contoured to be receivable within the urinal and wherein said upper surface has a multiplicity of baffles upstandingly positioned thereon, said base having a plurality of openings therethrough, said upper surface has a network of voids disposed thereupon, said base comprises a wedge with a thicker region disposed at a first edge of said base and wherein said mat is dimensioned such that when placed in a urinal, said first edge is positioned adjacent said urinal back wall and said lower surface lies over said drain.

2. The invention of claim 1 wherein said upper surface having a sloped region thereon adjacent said first edge, said first edge touchingly engageable with an inner surface of said urinal, said base contoured to rest overlying the drain thereof.

3. The mat of claim 1 wherein said baffles comprise coparallel elongate rods depending generally perpendicularly from said upper surface, said baffles create a textured surface.

4. The mat of claim 1 wherein said mat is molded from thermoplastic impregnated with fragrance.

5. The mat of claim 1 wherein said base has a cell configuration which allows the encapsulation of a fragrance that is slowly released during each use.

6. The mat of claim 1 wherein said base has a cell configuration which accepts a dye.

7. The mat of claim 1 wherein said baffles are disposed in groupings, having voids therebetween, said voids overlying at least some of said openings through said base.

8. The mat of claim 2 wherein said edge directs water passing down the inner surface of said urinal onto said upper surface of said base.

* * * * *